United States Patent [19]

Yokohori

[11] Patent Number: 4,561,549

[45] Date of Patent: Dec. 31, 1985

[54] APPARATUS FOR SUPPORTING BABY TOYS

[76] Inventor: Nobuyuki Yokohori, 10-12, Minamisuna 6-chome, Kohto-ku, Tokyo, Japan

[21] Appl. No.: 699,449

[22] Filed: Feb. 7, 1985

Related U.S. Application Data

[63] Continuation-in-part of Ser. No. 448,799, Dec. 10, 1982.

[51] Int. Cl.[4] ..... A47F 5/14

[52] U.S. Cl. ..... 211/182; 211/172; 248/105; 5/505; 5/508; 5/445

[58] Field of Search ..... 211/182, 206, 204, 198, 211/199, 171; 272/144, 63; 5/416, 418, 505; 248/558, 441 D, 454, 163.5, 185, 166, 105

[56] References Cited

U.S. PATENT DOCUMENTS

| | | | |
|---|---|---|---|
| 2,598,295 | 5/1952 | Pelton | 5/505 |
| 2,637,962 | 5/1953 | Reeve | 211/171 |
| 2,638,296 | 5/1953 | Battle | 248/105 |
| 2,639,111 | 5/1953 | Wells | 248/105 |
| 2,642,589 | 6/1953 | Cobb | 5/505 |
| 3,739,793 | 6/1973 | Wilson | 272/63 X |
| 3,787,049 | 1/1974 | Rellinger | 272/144 |

FOREIGN PATENT DOCUMENTS

| | | | |
|---|---|---|---|
| 870738 | 2/1953 | Fed. Rep. of Germany | 248/166 |
| 47871 | 5/1937 | France | 272/63 |

*Primary Examiner*—Robert W. Gibson, Jr.
*Assistant Examiner*—Blair M. Johnson
*Attorney, Agent, or Firm*—Fleit, Jacobson, Cohn & Price

[57] ABSTRACT

Apparatus for supporting baby toys above a base by means of a tubular support structure having upwardly extending bars to which oblique bars are pivotally connected. A connecting bar extends between the oblique bars to support baby toys. The elevation of the connecting bar above the base is adjustable by pivoting the oblique bars relative to the base.

12 Claims, 19 Drawing Figures

APPARATUS FOR SUPPORTING BABY TOYS

CROSS-REFERENCE TO RELATED APPLICATION

This application is a continuation-in-part of copending application Ser. No. 448,799, filed Dec. 10, 1982.

BACKGROUND OF THE INVENTION

The present invention relates to an apparatus for supporting baby toys, and more particularly to an apparatus for supporting baby toys or the like in the most desirable range for a nursing infant.

According to many recent studies on nursing infants, there is a growing trend which suggests that a toy or toys should be placed within reach of a lying infant during the period from birth until the infant is about eight months old. The use of these toys, however, has depended largely upon their shape and construction. Moreover, they are ordinarily arranged on the sides of a baby bed or around an infant. However, this is unsuitable because the visual range of a nursing infant as shown by studies on nursing infants is 1 m, or more precisely 60 to 70 cm, wherein an infant has an interest in objects.

Accordingly, it is an object of the present invention to provide an apparatus for supporting a commercial toy, home-made toy or similar goods at the most desirable distance from a nursing infant, regardless of where the infant is lying, for the purpose of viewing and touching.

It is another object of the present invention to provide an apparatus to be used for other purposes, thereby ensuring longtime use beyond the short nursing peroid of an infant.

SUMMARY OF THE INVENTION

Briefly stated, in accordance with one aspect of the present intention, an apparatus for supporting baby toys is provided and includes at least two side legs which are positioned at a certain distance on right and left sides, and a connecting leg extending between the at least two side legs. Vertical members extend upwardly from an end of each of the side legs and are adjustable in height. A reinforcing bar extends between the vertical members, and an upstanding support means extends upwardly from the reinforcing bar. Oblique bars extend from upper ends of the vertical members and are pivotally connected therewith to allow upward pivoting of the oblique bars from a horizontal position. A connecting member to which baby toys can be attached or hooked extends between the oblique bars, and adjusting means, such as a strap, extends between the upstanding support means and the connecting member to adjust the angular orientation of the oblique bars relative to the vertical members.

DESCRIPTION OF THE PREFERRED EMBODIMENTS

Referring to the attached drawings, the construction and functions of each preferred embodiment of the present invention will be described.

Figure 1:
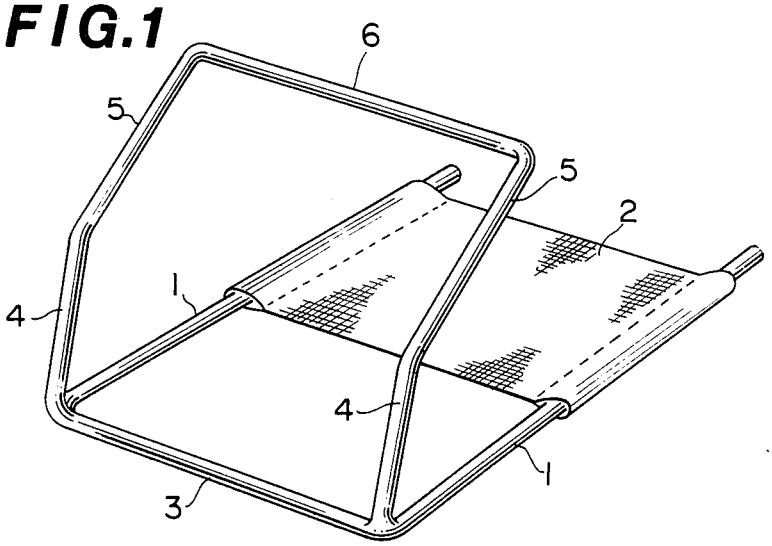
FIGS. 1 to 4 are perspective views of preferred embodiments of the present invention.

In a preferred embodiment of the present invention illustrated in FIG. 1, legs 1 are positioned at a proper distance on right and left sides. A cloth 2 is extended over the two legs 1 on both sides. A connecting leg 3 is provided between the two legs 1 at the top ends thereof. Vertical bars 4 extend upwardly from corresponding ends of the two legs 1, and oblique bars 5 extend at angles from upper portions of the vertical bars 4. A connecting bar 6 is provided between the two oblique bars 5 at the top ends thereof. Baby toys are attached or hooked to the connecting bar 6, or to a member which extends between the oblique bars 5 on either side, by using suitable suspending members, such as straps or bands.

Figure 2:
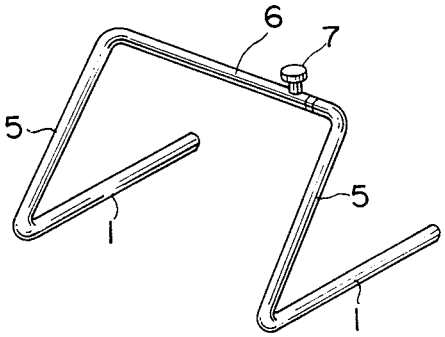

In a preferred embodiment of the present invention illustrated in FIG. 2, legs 1 are positioned on right and left sides. Oblique bars 5 extend at oblique angles from corresponding ends of the legs 1. A connecting bar 6 is provided between the oblique bars 5 at the top ends thereof. Connecting bar 6 can be divided into two parts, which are joined by a screw 7 to adjust the spacing between the two legs 1.

Figure 3:
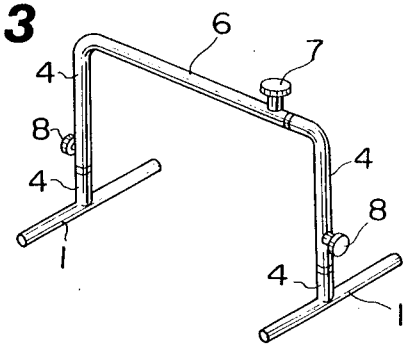

In a preferred embodiment of the present invention illustrated in FIG. 3, legs 1 are positioned on right and left sides. Vertical bars 4 extend vertically from centers of the two legs 1, and are divided into two parts which are joined by a screw 8 to adjust the height thereof. A connecting bar 6 is provided between the two vertical bars 4 at the top ends thereof, and is divided into two parts which are joined by a screw 7 to adjust the distance between the two vertical bars 4.

Figure 4:
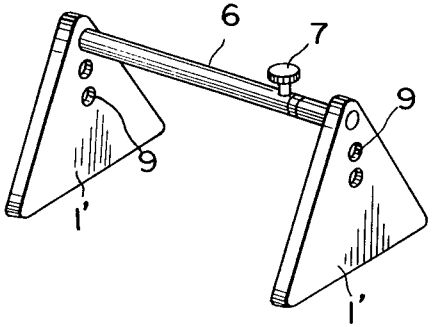

Moreover, in a preferred embodiment of the present invention illustrated in FIG. 4, legs 1' are extended vertically and positioned on right and left sides. A connecting bar 6 extends between the two legs 1' at the top ends thereof, and is divided into two parts which are joined by a screw 7 to adjust the distance between the two legs 1'. Holes 9 are provided in the two legs 1' to permit adjustment of the height of the connecting bar 6.

Figure 5:
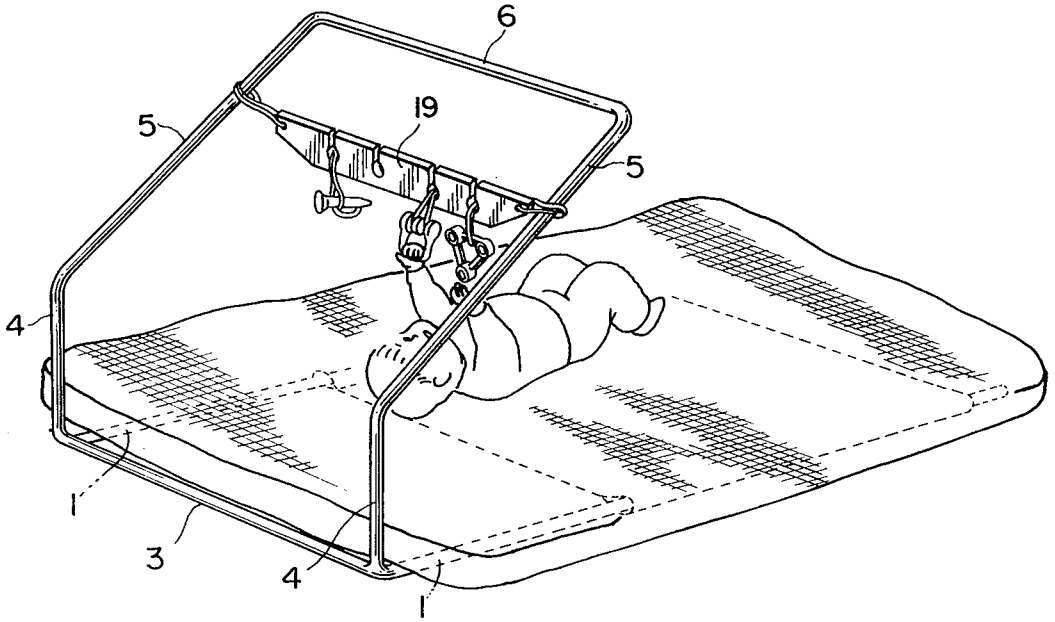
FIG. 5 is a perspective view showing an application of the embodiment illustrated in FIG. 1.

In each embodiment mentioned above, the connecting bar is arranged above the face of a nursing infant lying on his back on bedding. More specifically, in the first and second embodiments, the legs 1 are positioned under the bedding. In the third and fourth embodiments, the legs 1 or 1' are positioned on either side of the bedding. Under these conditions, a baby toy, which is hooked to the connecting bar 6 via a suspending member, is suspended above the face of a nursing infant. FIG. 5 shows an application of the embodiment illustrated in FIG. 1, in which the baby toys are suspended from a supporting member 19.

Figure 6:
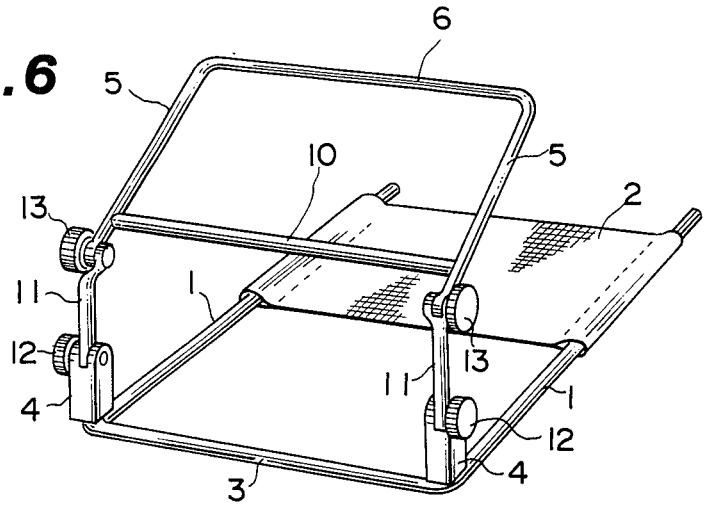

Next the preferred embodiment of the present invention illustrated in FIG. 6 will be described. Legs 1 are positioned at a proper distance on right and left sides. A cloth 2 is extended over the two legs 1 on both sides. A connecting leg 3 is provided between the two legs 1 at corresponding ends thereof. Vertical bars 4 extend vertically from the two legs 1 at the top ends thereof. Intermediate bars 11 are joined to the vertical bars 4 via adjusting screws 12. Oblique bars 5 are joined to ends of the intermediate bars 11 via adjusting screws 13. A connecting bar 6 is provided between the two oblique bars 5 at the outer ends thereof, and an auxiliary connecting bar 10 is provided between the two oblique bars 5 at an intermediate portion thereof.

Figure 7:
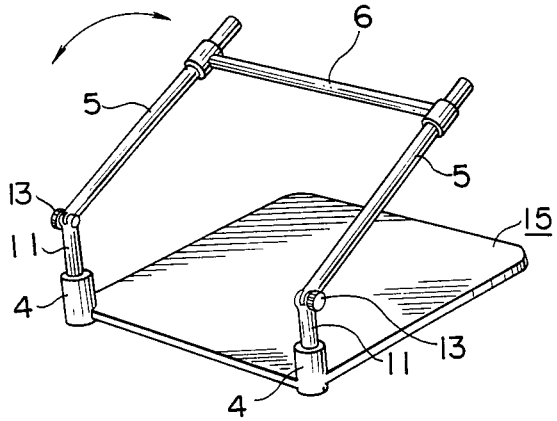

In a preferred embodiment of the present invention illustrated in FIG. 7, a seating plate 15 is provided. Vertical bars 4 each extend vertically from one end on each side of the seating plate 15, with or without intermediate bars 11 connected. Oblique bars 5 are joined to the intermediate bars 11 through adjusting screws 13. A connecting bar 6 is provided between the two oblique bars 5.

Figure 9:
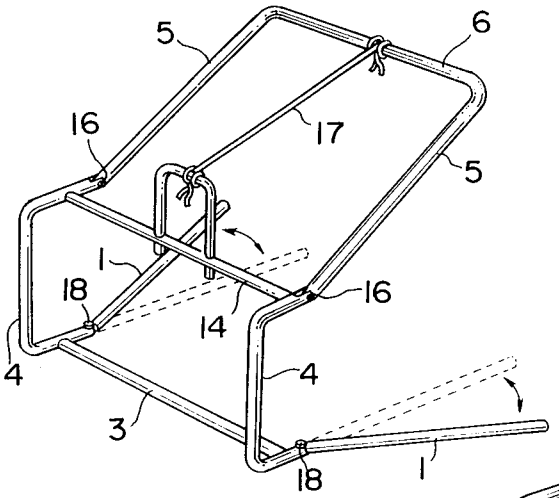
FIGS. 6 to 9 are perspective views of other preferred embodiments of the present invention.
Figure 8:
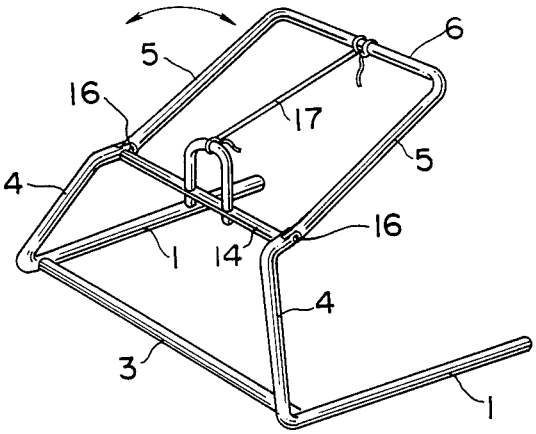

In preferred embodiments of the present invention illustrated in FIGS. 8 and 9, legs 1 are positioned on right and left sides. A connecting leg 3 is provided between the two legs 1 at corresponding ends thereof. Vertical bars 4 extend vertically from the corresponding ends of the two legs 1. Oblique bars 5 having a connecting bar 6 are joined to upper ends of the vertical bars 4 through pins 16. A reinforcing bar 14 is provided between the vertical bars 4 at the upper ends thereof. A suitable adjusting means 17 such as a strap extends between the reinforcing bar 14 and connecting bar 6 so as to adjust the angle of the oblique bars 5 and connecting bar 6. In FIG. 9, legs 1 can be opened outwardly by means of pinned connections by pins 18.

A preferred embodiment of the present invention illustrated in FIG. 9 combines the embodiments shown in FIGS. 7 and 8, in which a suitable adjusting means 17, such as a strap, extends between the reinforcing bar 14 and connecting bar 6 for angular adjustment.

Figure 10:
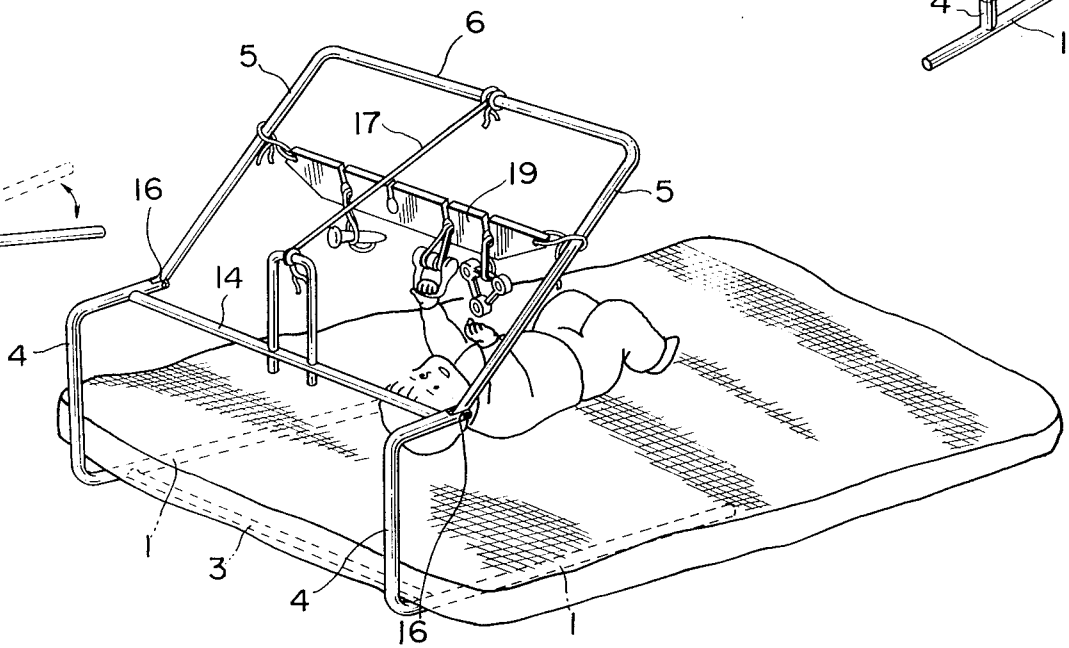
FIG. 10 is a perspective view showing an application of the embodiment illustrated in FIG. 8.

FIG. 10 shows an application of the embodiment shown in FIG. 8, in which bedding is used and a suspending member 19 is provided between the two oblique bars 5 from which an assortment of baby toys are hung.

In the foregoing embodiments, baby toys may be hung from the connecting bar 6, from the suspending member 19 extending between the two oblique bars 5, or from the oblique bars 5 directly.

Figure 11:
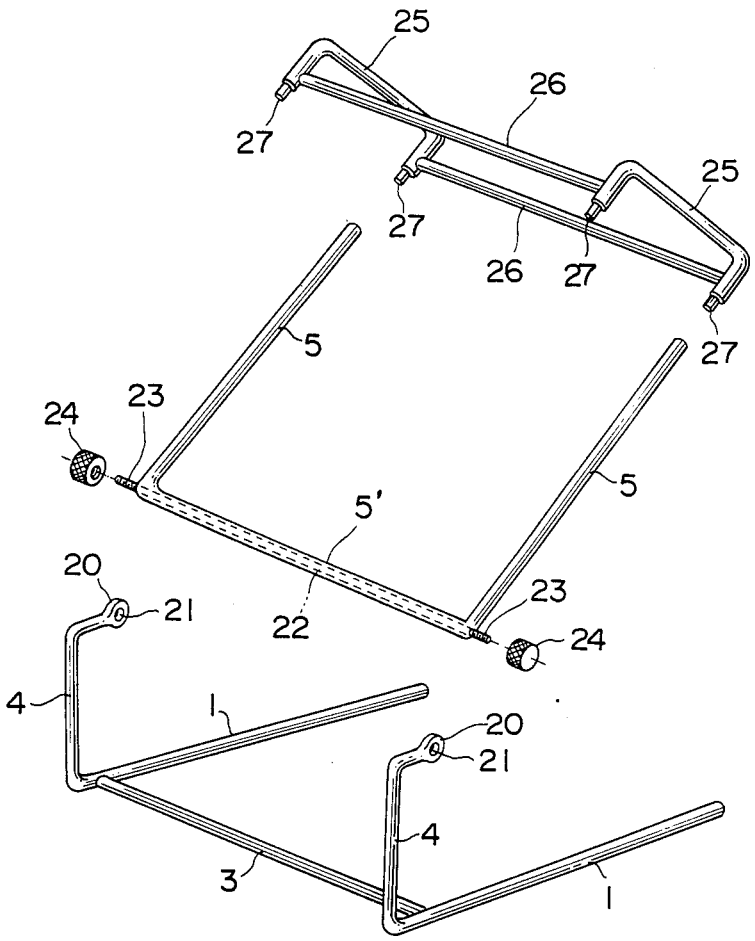
FIGS. 11 to 14 are perspective views of other preferred embodiments of the present invention.

In a preferred embodiment of the present invention illustrated in FIG. 11, vertical bars 4 extend from the corresponding ends of the two legs 1, and connected by a connecting leg 3. Top edges 20 of both side vertical bars 4 are flattened and provided with through holes 21. A U-shaped frame including legs 5 is made of tube material. A shaft 22 passes through a transverse tube 5' of the frame, extends beyond legs 5, and is provided with threads 23 at both ends which pass through the holes 21 at the top edges 20 of the side legs 1 and engage with nuts 24. Accordingly, an oblique angle of the frame can be freely adjusted or fixed by loosening or tightening the nuts 24.

Figure 12:
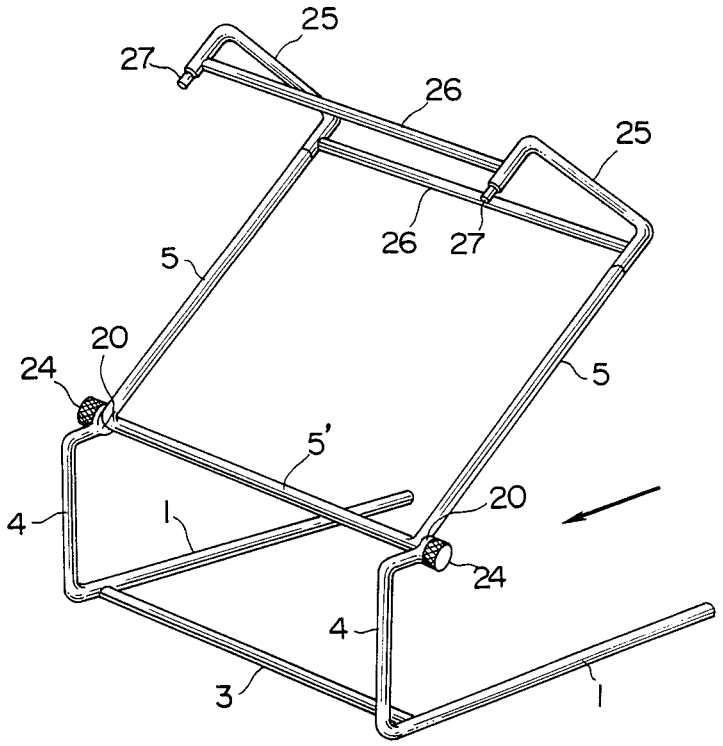
Figure 13:
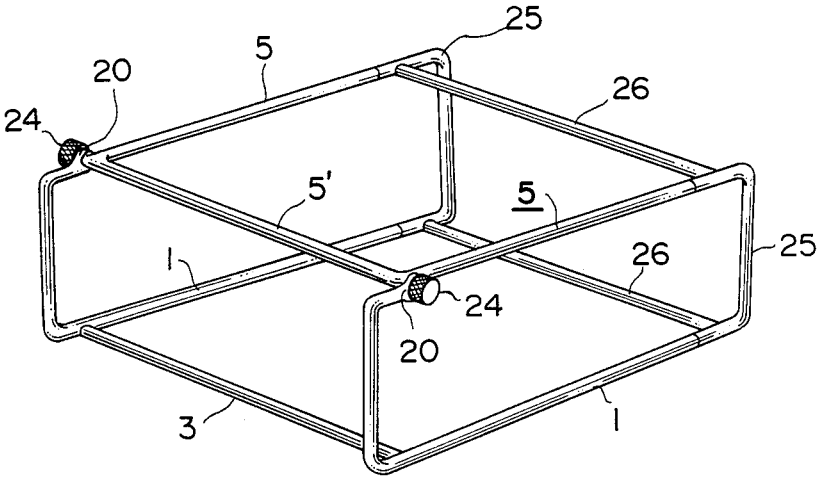
Figure 14:
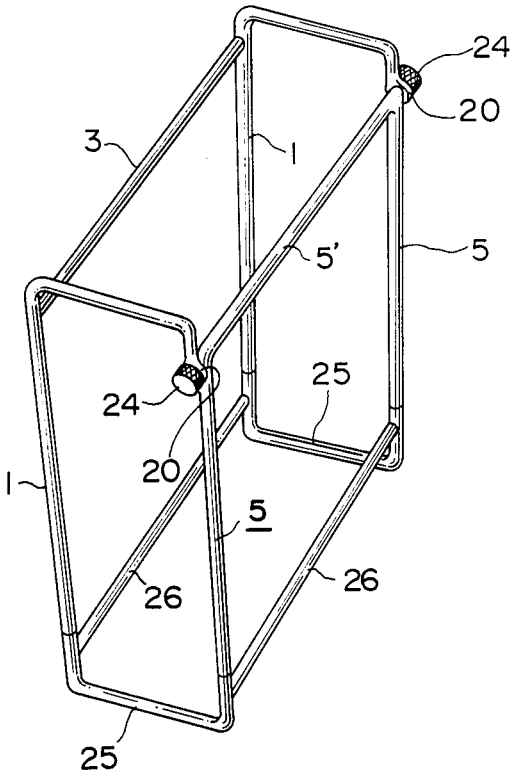

Auxiliary frames 25 are arranged on right and left sides, and connected by connecting bars 26 at the top and bottom thereof. The width and height of the assembly of the auxiliary frames 25 and connecting bars 26 are similar to those of the side legs 1 and the frames 5. Four insert portions 27 of the auxiliary frames 25 are to be inserted into four edges of the side legs 1 and legs 5 as shown in FIG. 13, or into only two edges of the frames 5 as shown in FIG. 12. FIG. 14 shows an upright position of an assembly illustrated in FIG. 13.

When the apparatus is assembled as shown in FIG. 12, the right and left side legs 1 are moved under bedding or a mattress in the direction of the arrow, and the inclination of the legs 5 is set at an appropriate angle and locked by the nuts 24. The inclination angle of the legs 5 is determined by bearing in mind that the reach of an infant is 15 to 18 cm in height for touching a toy. After this setting, a toy or the like is directly bound to or hung on the legs 5 or a bridge member which extends between the legs 5.

With the auxiliary frames 25 being connected to the legs 5, a toy or the like is hung on the auxiliary frames 25 or the connecting member 26. This toy-hanging position should be determined in a forward oblique direction where an infant's eyes turn naturally and where he can reach out his hands for touching, not just above a lying infant, because an infant's interest is taken in angled directions (right and left) rather than in the front direction.

In FIG. 13, four edges of the auxiliary frames 25 are inserted into edges of the side legs 1 and legs 5, respectively, to form a box frame. In this embodiment, the apparatus can be used in a wide range of applications according to the user's ideas and needs, for example, as a table by placing a suitable board on the top side of the box frame, as a cabinet by covering it with cloth or the like, and as a walking chair by attaching casters.

In FIG. 14, the auxiliary frames 25 are joined to the side legs 1 and legs 5 similar to FIG. 13 but the formed box is in an upright position. In this embodiment, the apparatus can be used as a cabinet by covering it with cloth or the like, and as a wagon by attaching a board and casters.

Since the present invention has the construction and functions as described above, the present invention has the following advantages. First, the present invention can provide an apparatus for supporting baby toys which is an ideal infant nursing means that can always support a toy or toys within reach of an infant lying on a bed or mattress to let him see and touch them freely and satisfactorily. Second, since the toy-hanging bar can be freely adjusted in height, its level can be suited to the growth of an infant, thus being very useful. Third, the present invention can provide an extremely versatile means to be used as a table or a walking chair for an infant by adding a few accessories, even after the nursing period of the infant. The present invention can also be used as a cabinet and a wagon. In short, practical effects of the present invention will be great because of the aforesaid economical, longtime use beyond the nursing period of an infant.

Figure 15:
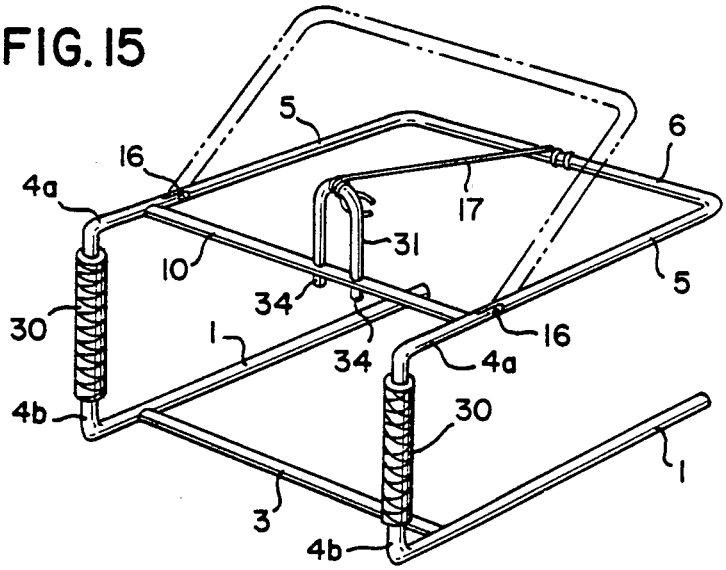
FIGS. 15 to 19 show further preferred embodiments of the invention and the interconnection between the several parts thereof.

As shown in the embodiment of FIG. 15, vertical members extend upwardly from the corresponding ends of each of the spaced, substantially parallel side legs 1 and are separated into an upper part **4*a* and a lower part 4*b*, which are connected by elongated lock nuts 30 whereby the vertical members are freely adjustable in height. Oblique bars 5 are pivotally connected to upper ends of the vertical members 4*a* and can be locked in at least a horizontal position at joints 16 by adjusting means, such as adjusting screws 13 as shown in FIGS. 6 and 7, and without the support of a strap 17, and they can be freely pivoted upwardly to a position as shown in phantom in FIG. 15. The strap 17, which can be a rope, or the like, serves to hold the oblique bars 5 in a desired oblique position relative to side legs 1. A connecting bar 6 extends the ends of oblique bars 5. Reinforcing bar 10** includes an upstanding, inverted U-shaped support member to which strap 17 can be connected at the upper portion thereof to extend to connecting bar 6 to support the same at a desired angular orientation.

Figure 16:
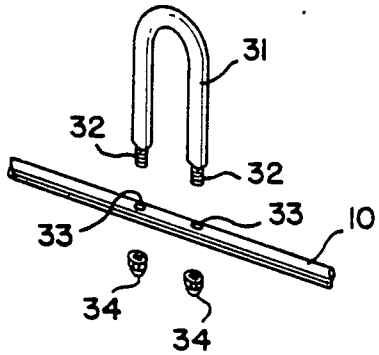

In FIG. 16, the inverted U-shaped support member 31 there shown extends upwardly from and is detachably carried by a reinforcing bar 10 which extends between the vertical members. Support member 31 has threaded portions 32 at both ends thereof which can pass through holes 33 in the reinforcing bar 10 and can be secured thereto by nuts 34.

Figure 17:
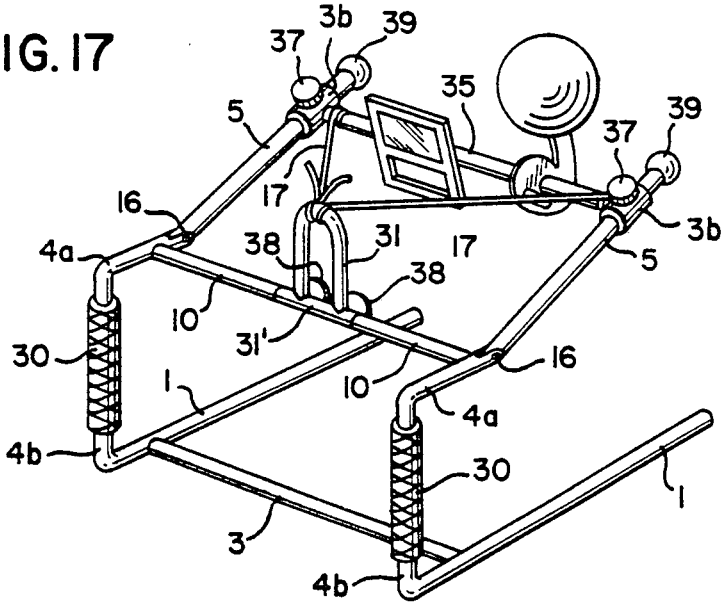
Figure 18:
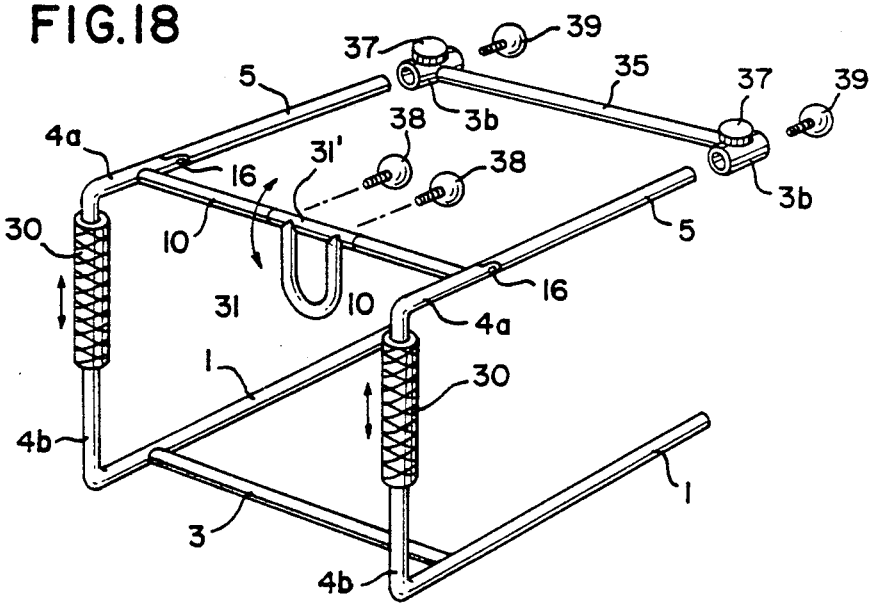
Figure 19:
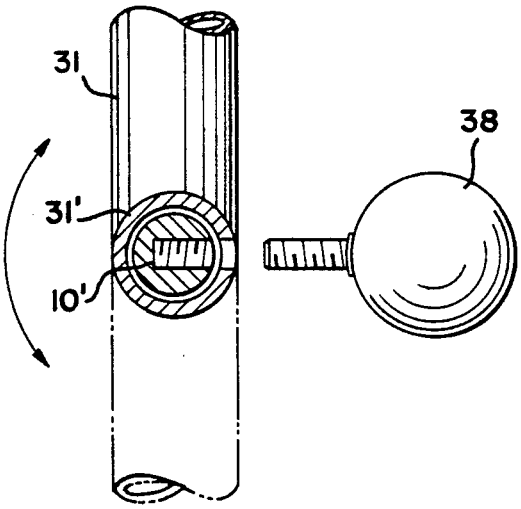

In FIGS. 17 and 18, the vertical members and the oblique bars 5 have the same construction as the embodiment shown in FIG. 15, but also includes a connecting bar 35, to which baby toys are attached or hooked, and that extends between the oblique bars 5. A pair of straps or ropes 17 are connected in a V-shape between the uppermost part of support member 31 and the outer ends of connecting bar 35. The connecting bar 35 is adjustably secured, at both ends thereof, to oblique bars 5, by adjustment bolts 37 that extend through T-shaped connectors 36, which are slidably carried on the oblique bars 5 and are secured to the outer ends of connecting bar 35. End caps 39 are provided at the ends of oblique bars 5 as a stop means for the slidable connectors 36 to prevent their passage over the ends of oblique bars 5. In this embodiment, the inverted U-shaped support member 31 has a transversely extending, integral base 31', the ends of which receive ends of two spaced, coaxially arranged inwardly extending reinforcing bars 10, which are provided in separated form at the left and right sides, and are secured thereto by setscrews 38. When setscrews 38 are loosened, the support member 31 can turn around the axis of the base 31' to face downward as shown in FIG. 18. In FIG. 19, the base 31' of the support member 31 is shown in cross section in position over an inner end of the reinforcing bar 10, and setscrew 38 is shown spaced therefrom to illustrate the connection therebetween.

Although particular embodiments of the present invention have been illustrated and described, it will be apparent to those skilled in the art that various changes and modifications can be made without departing from the spirit and scope of the invention, and it is intended to cover in the appended claims all such changes and modifications that fall within the scope of the present invention.

What is claimed is:

1. An apparatus for supporting baby toys comprising: at least two side legs which are positioned at a certain distance on right and left sides, a connecting leg extending between said at least two side legs, at least two vertical members each of which extends upwardly from an end of one of said legs and is adjustable in height, a reinforcing bar extending between said vertical members, an upstanding support means extending upwardly from and detachably carried by said reinforcing bar, oblique bars which extend forward from upper ends of said vertical members and are pivotally connected therewith to allow upward pivoting of the oblique bars from a horizontal position, a connecting member to which baby toys can be attached extending between the oblique bars, and adjusting means, such as a strap, extending between said upstanding support means and said connecting member to adjust the angular orientation of said oblique bars relative to said vertical members.

2. An apparatus for supporting baby toys as claimed in claim 1 including a pair of U-shaped auxiliary frames which are connected by a pair of connecting bars, said frames including insert portions at each of the ends thereof; said oblique bars and said side legs each having ends adapted to receive said insert portions; said connecting bars having a length substantially equal to the length of said connecting leg so that the width and height of the auxiliary frames are substantially equal to those of the assembly of said side legs and oblique bars.

3. An apparatus for supporting baby toys, said apparatus comprising:

means defining a base;

a pair of spaced, upwardly extending support members connected to said base means;

an oblique bar pivotally connected to and extending from each of said support members;

a reinforcing bar connected to and extending between said support members;

an upstanding support member extending upwardly from said reinforcing bar;

a connecting member extending between said oblique bars and substantially parallel to said base means, said connecting member adapted to support baby toys above said base means, whereby the elevation of said connecting member above said base means can be adjusted by pivoting said oblique bars relative to said support members, and adjusting means extending between and connected to each of said connecting member and said upstanding support member to maintain said oblique bars in a desired angular orientation relative to said support members.

4. The apparatus of claim 3 wherein said apparatus includes means for securely positioning said oblique bars at an acute angle relative to said base means.

5. The apparatus of claim 4 wherein said apparatus includes adjusting means for adjusting the angle of the oblique bars.

6. The apparatus of claim 3 wherein said adjusting means includes a strap extending between said connecting member and said reinforcing bar.

7. The apparatus of claim 6 wherein said base means includes at least two side legs and said side legs are pivotable within the plane of said base means.

8. The apparatus of claim 3 including a suspending member extending between and secured to said oblique bars, said suspending member positioned between and substantially parallel to said connecting member and said reinforcing bar.

9. The apparatus of claim 3 wherein said upstanding support means is an inverted, U-shaped member.

10. The apparatus of claim 3 wherein said connecting member is slidably carried relative to said oblique bars and includes securing means to secure said connecting member in a desired position relative to said oblique bars.

11. The apparatus of claim 10 wherein said securing means includes a T-shaped connector carried at each end of said connecting member and slidable along said oblique bars, and setscrew means carried on said T-shaped connectors to engage with said oblique bars and hold said connecting member thereto.

12. The apparatus of claim 9 wherein said U-shaped member includes a transversely extending, integral base and said reinforcing bar is provided as a pair of inwardly directed portions, said base of said U-shaped member having ends that receive inwardly facing ends of said reinforcing bar portions, and setscrew means for securely connecting said reinforcing bar portions and the base of said U-shaped member.

* * * * *